US008690268B2

(12) United States Patent
Kang

(10) Patent No.: US 8,690,268 B2
(45) Date of Patent: Apr. 8, 2014

(54) LAUNDRY TREATING APPARATUS

(71) Applicant: Dong Woo Kang, Changwon-si (KR)

(72) Inventor: Dong Woo Kang, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 13/788,333

(22) Filed: Mar. 7, 2013

(65) Prior Publication Data

US 2013/0185914 A1 Jul. 25, 2013

Related U.S. Application Data

(63) Continuation of application No. 12/042,611, filed on Mar. 5, 2008, now abandoned.

(30) Foreign Application Priority Data

| | | |
|---|---|---|
| Mar. 6, 2007 | (KR) | 10-2007-0021920 |
| Mar. 6, 2007 | (KR) | 10-2007-0021921 |
| Mar. 6, 2007 | (KR) | 10-2007-0021922 |
| Mar. 6, 2007 | (KR) | 10-2007-0021923 |
| Mar. 6, 2007 | (KR) | 10-2007-0021924 |
| Mar. 6, 2007 | (KR) | 10-2007-0021925 |
| Jan. 10, 2008 | (KR) | 10-2008-0002963 |
| Jan. 10, 2008 | (KR) | 10-2008-0002965 |
| Jan. 10, 2008 | (KR) | 10-2008-0002966 |

(51) Int. Cl.
*A47B 77/06* (2006.01)
*A47G 29/00* (2006.01)

(52) U.S. Cl.
USPC ..... 312/228; 312/265.5

(58) Field of Classification Search
USPC ..... 312/228, 257.1, 265.5, 265.6; 134/200; 34/603; 68/3 R
See application file for complete search history.

(56) References Cited

U.S. PATENT DOCUMENTS

| | | | |
|---|---|---|---|
| 2,378,982 | A | 6/1945 | Chesney |
| 3,491,573 | A | 1/1970 | Tennison, Sr. |
| 3,844,154 | A | 10/1974 | Bozek |
| 3,908,854 | A | 9/1975 | Long |
| 4,660,734 | A | 4/1987 | Heaney et al. |
| 4,890,471 | A | 1/1990 | Ito |
| 4,909,580 | A | 3/1990 | Mitchell |
| 5,016,458 | A | 5/1991 | De Smet |
| 5,152,047 | A | 10/1992 | Kojima et al. |
| 5,584,549 | A | 12/1996 | Lybarger et al. |

(Continued)

FOREIGN PATENT DOCUMENTS

| | | |
|---|---|---|
| DE | 197 50 946 | 10/1998 |
| EP | 0 579 064 A1 | 1/1994 |

(Continued)

OTHER PUBLICATIONS

International Search Repot dated Jul. 22, 2009 (PCT/KR2008/001272).

(Continued)

*Primary Examiner* — Darnell Jayne
*Assistant Examiner* — Timothy M Ayres
(74) *Attorney, Agent, or Firm* — KED & Associates LLP

(57) ABSTRACT

A laundry treating apparatus is provided which can be manufactured easily. The laundry treating apparatus includes a cabinet, a drum rotatably disposed in the cabinet configured to hold laundry therein, a front cover including a door opening to load the laundry in the drum, and at least one panel opening configured to receive a control panel therein.

22 Claims, 6 Drawing Sheets

(56) References Cited

U.S. PATENT DOCUMENTS

| | | | |
|---|---|---|---|
| 5,611,609 | A | 3/1997 | Katz et al. |
| 5,644,943 | A | 7/1997 | Lanz |
| 5,797,150 | A | 8/1998 | Lanz |
| 5,974,847 | A | 11/1999 | Saunders et al. |
| 6,260,402 | B1 | 7/2001 | Leek |
| 6,557,720 | B2 | 5/2003 | Tosdale et al. |
| 7,275,398 | B2 | 10/2007 | Kim et al. |
| 2003/0205954 | A1 | 11/2003 | Oyler et al. |
| 2004/0107738 | A1 | 6/2004 | Kim et al. |
| 2004/0123633 | A1 | 7/2004 | Jo |
| 2004/0168484 | A1 | 9/2004 | Kim et al. |
| 2004/0169449 | A1 | 9/2004 | Kim |
| 2005/0178164 | A1 | 8/2005 | Kim et al. |
| 2006/0016075 | A1 | 1/2006 | Oki et al. |
| 2006/0059710 | A1 | 3/2006 | Kim |
| 2006/0059711 | A1 | 3/2006 | Kim et al. |
| 2006/0255700 | A1 | 11/2006 | Park et al. |
| 2006/0260640 | A1 | 11/2006 | Son et al. |
| 2007/0017258 | A1 | 1/2007 | Son et al. |
| 2007/0266742 | A1 | 11/2007 | Yoon et al. |
| 2008/0225016 | A1 | 9/2008 | Lee |
| 2008/0235935 | A1 | 10/2008 | Kang |
| 2008/0245114 | A1 | 10/2008 | Kang |

FOREIGN PATENT DOCUMENTS

| | | | |
|---|---|---|---|
| GB | 2 022 621 | | 12/1979 |
| GB | 2 168 387 | | 6/1986 |
| JP | 59-60357 | | 4/1984 |
| JP | 62-134123 | | 6/1987 |
| JP | 02-46931 | A | 2/1990 |
| JP | 6-542 | | 1/1994 |
| JP | 06234123 | | 8/1994 |
| JP | 06269595 | | 9/1994 |
| JP | 06-315725 | A | 11/1994 |
| JP | 2000/263180 | | 9/2000 |
| KR | 1998-029665 | | 7/1998 |
| KR | 10-2002-0048578 | | 6/2002 |
| KR | 10-2005-0008146 | | 1/2005 |
| KR | 10-2006-0087214 | | 8/2006 |
| KR | 10-2006-0112986 | | 11/2006 |
| KR | 2003-0092187 | | 12/2006 |
| RU | 2 011 715 | | 4/1994 |
| RU | 2242317 | | 1/2005 |
| SU | 439329 | | 8/1974 |
| SU | 1747575 | | 1/1990 |
| SU | 1542664 | | 2/1990 |
| WO | WO 2006/095998 | | 9/2006 |

OTHER PUBLICATIONS

International Search Report dated Jul. 22, 2009 (PCT/KR2008/001273).

International Search Report dated Jul. 22, 2009.

U.S. Office Action issued in U.S. Appl. No. 12/042,611 dated Apr. 13, 2010.

Russian Office Action dated Jun. 23, 2010. (translation).

Russian Office Action dated Oct. 11, 2010 (Application No. 2009136699).

Russian Office Action dated Oct. 15, 2010 (Application No. 2009136698).

Russian Office Action dated Oct. 21, 2010 (Application No. 2009136689(051910).

U.S. Office Action issued in U.S. Appl. No. 12/042,611 dated Oct. 27, 2010.

U.S. Office Action dated Jan. 31, 2011 issued in U.S. Appl. No. 12/042,617.

European Search Report dated May 4, 2011.

U.S. Office Action issued in U.S. Appl. No. 12/042,611 dated May 16, 2011.

U.S. Office Action issued in U.S. Appl. No. 12/042,617 dated Jul. 26, 2011.

U.S. Office Action issued in U.S. Appl. No. 12/042,611 dated Dec. 7, 2011.

U.S. Office Action issued in U.S. Appl. No. 12/042,611 dated Jun. 21, 2012.

U.S. Office Action issued in U.S. Appl. No. 12/042,611 dated Nov. 7, 2012.

FIG. 5

Properties of STS series of stainless steel
Tensile test

| Stainless steel | thickness | direction | Y.S ($kg/mm^2$) | T.S ($kg/mm^2$) | EL (%) | U-EL (%) | R | Lankford | dR |
|---|---|---|---|---|---|---|---|---|---|
| 304 | 0.967 | 0 | 33.5 | 75.9 | 52.9 | 49.1 | 0.86 | 0.98 | −0.31 |
| | | 90 | 34.1 | 72.6 | 58.1 | 54.6 | 0.79 | | |
| | | 45 | 32.3 | 70.6 | 58.3 | 54.2 | 1.13 | | |
| 304L | 0.939 | 0 | 31.0 | 65.9 | 49.9 | 44.1 | 0.73 | 1.00 | −0.45 |
| | | 90 | 30.8 | 63.3 | 59.5 | 53.0 | 0.83 | | |
| | | 45 | 28.5 | 60.2 | 58.7 | 51.1 | 1.22 | | |
| 304J1L | 0.993 | 0 | 28.1 | 64.9 | 53.4 | 49.6 | 0.74 | 1.00 | −0.39 |
| | | 90 | 27.5 | 61.8 | 58.6 | 54.7 | 0.87 | | |
| | | 45 | 27.6 | 61.6 | 58.0 | 54.0 | 1.19 | | |
| 316L | 0.946 | 0 | 28.7 | 60.8 | 48.0 | 41.1 | 0.51 | 1.01 | −0.26 |
| | | 90 | 30.3 | 62.3 | 54.3 | 47.1 | 1.25 | | |
| | | 45 | 29.5 | 59.9 | 51.9 | 44.3 | 1.14 | | |

LAUNDRY TREATING APPARATUS

This application is a Continuation of U.S. patent application Ser. No. 12/042,611, filed Mar. 5, 2008, which claims priority under 35 U.S.C. §119 to Korean Patent Application Nos. 10-20007-0021920, 10-2007-0021921, 10-2007-0021922, 10-2007-0021923, 10-2007-0021924, and 10-2007-0021925, filed on Mar. 6, 2007, and 10-2008-002963, 10-2008-0002965, and 10-2008-0002966, filed on Jan. 10, 2008 in Korea. The entire disclosure of the prior application is considered as being part of the disclosure of the accompanying application and is hereby incorporated by reference therein.

BACKGROUND

1. Field

A laundry treating apparatus is disclosed herein.

2. Background

Laundry treating apparatuses are known. However, they suffer from various disadvantages.

BRIEF DESCRIPTION OF THE DRAWINGS

Embodiments will be described in detail with reference to the following drawings in which like reference numerals refer to like elements, and wherein:

FIG. 5 is table illustrating properties of the STS 300 series of stainless steel.

DETAILED DESCRIPTION

Reference will now be made in detail to embodiments, examples of which are illustrated in the accompanying drawings. Wherever possible, like reference numbers have been used throughout the drawings to refer to the same or like parts. In this specification, a washer is embodied as a laundry treating apparatus to explain embodiments; however, the concepts disclosed herein may also be applicable to other laundry treating apparatus, such as a dryer and a laundry treating apparatus having a washing and drying function.

Figure 1:
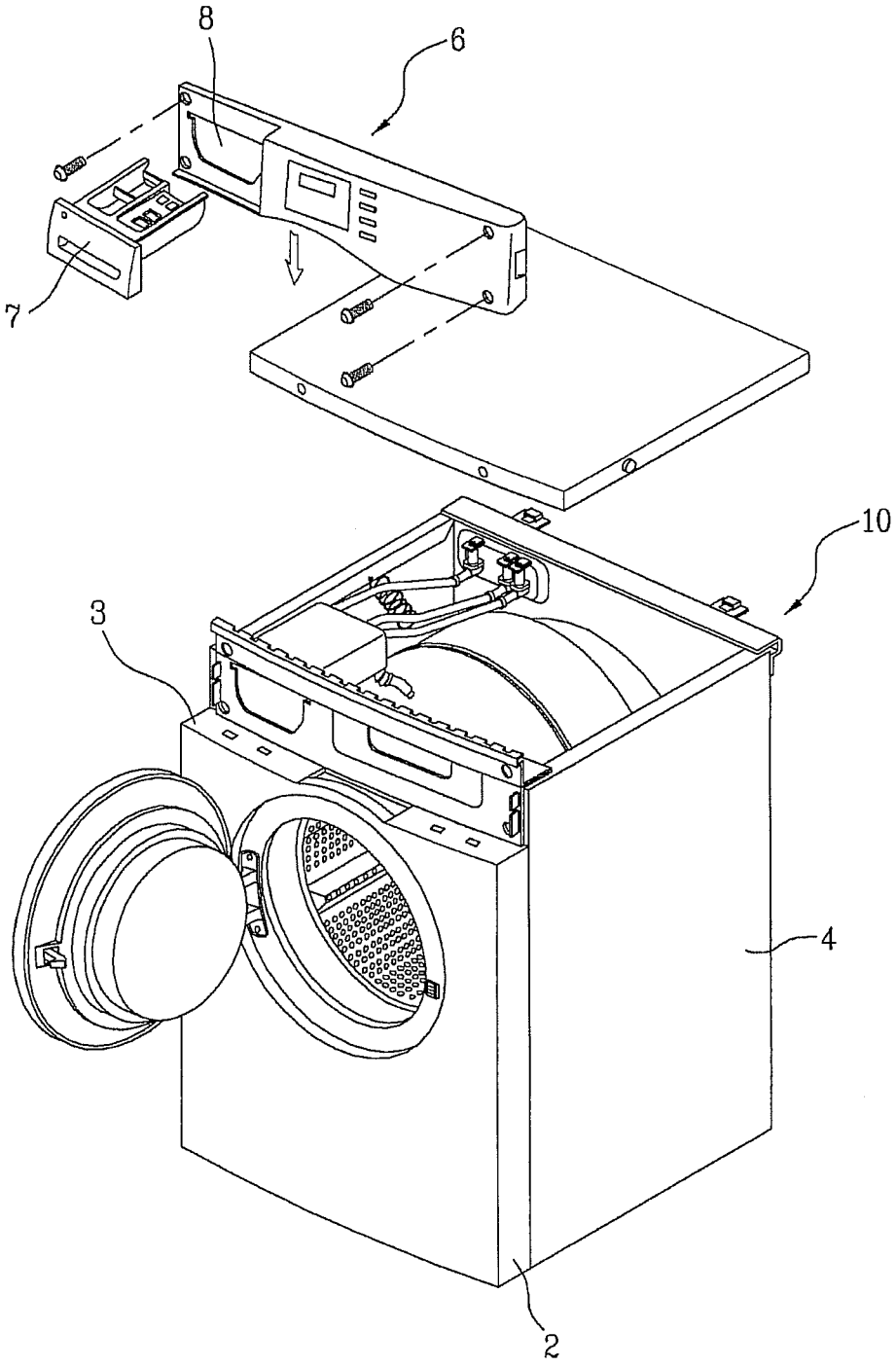
FIG. 1 is a perspective view illustrating an assembling process of a laundry treating apparatus according to an embodiment.

Laundry treating apparatuses are generally electric appliances including washers, dryers and combined laundry machines having washing/drying functions that can wash and/or dry laundry such as clothes, cloth items, beddings, and similar items. FIG. 1 is a perspective view of a laundry treating apparatus according to an embodiment, in this case a drum type washer, illustrating an assembly process of the laundry treating apparatus, in particular, a method of mounting a control panel on a front cover of the laundry treating apparatus. More specifically, a tub (not shown) of the washer 10 is mounted between side surfaces 4 and a front cover 2 is coupled to the side surfaces 4 to define a front surface of the washer 10. A control panel 6 is mounted in a recessed part 3 formed in an upper portion of the front cover 2. That is, in the washer of FIG. 1, the front cover 2 is installed first and then the auxiliary control panel 6 is mounted thereto. A detergent box 7 is retractable through an opening 8 formed in the control panel 6.

However, with this method of manufacturing assembly lines needed to assemble such a washer are increased, because the control panel 6 is separate from the front cover and must be separately installed. Moreover, the front cover is commonly formed of steel. After molding the front cover in an appropriate shape, a coating process is performed to prevent corrosion. As a result, after the steel molding process, the coating process must be then performed again in the conventional washer.

Figure 2:
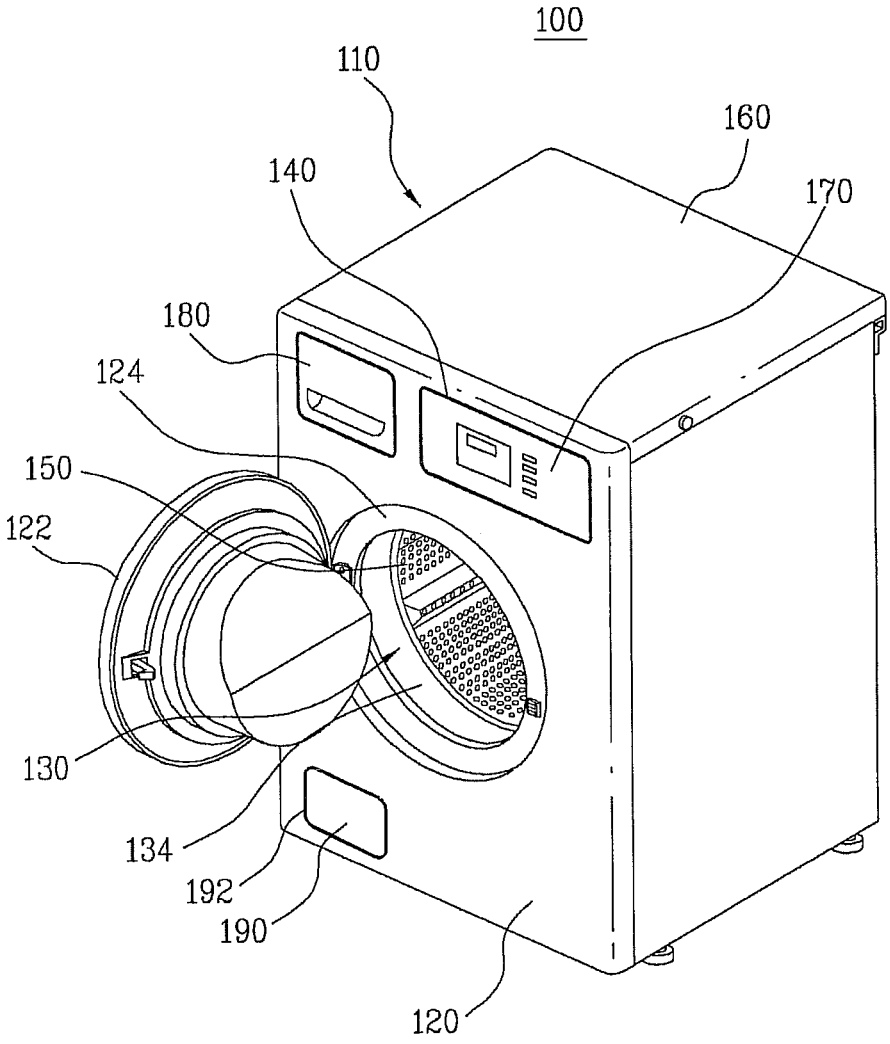
FIG. 2 is a front perspective view of a laundry treating apparatus according to another embodiment.

FIG. 2 is a front perspective view of a laundry treating apparatus according to an embodiment. FIG. 2 shows a washer 100. The washer 100 includes a cabinet 110, a drum 150, and a front cover 120. The cabinet 110 may define an exterior appearance of the washer 100. The drum 150 may be rotatably disposed within the cabinet 110 and laundry may be held in the drum 150. The front cover 120 may define a front surface of the cabinet 100.

A front portion of the cabinet 110 may be opened and the opened portion may be covered by the front cover 120. Alternatively, a front part (not shown) of the cabinet 110 may be formed in advance and the front cover 120 may be additionally secured to the front part (not shown) of the cabinet 110. In this embodiment, the front portion of the cabinet 110 is disclosed as formed open and the opened portion covered by the front cover 120.

As set forth above, the cabinet 110 may define the exterior appearance of the washer 100, and the drum 150 and a tub (not shown) may be provided in the cabinet 110. The front portion of the cabinet 120 may be opened and may be covered by the front cover 120, which will be described in detail hereinafter. An upper portion of the cabinet 110 may be covered by an upper cover 160.

The front cover 120 may be secured to the opened front portion of the cabinet 110 to cover the opened portion. More specifically, a door opening 130 and at least one panel opening 140 may be formed in the front cover 120 according to this embodiment. A door 122 may be coupled to the door opening 130 for the laundry to be loaded into the drum 150 and a control panel device 170 may be mounted in the panel opening 140. That is, both the door opening 130 and the panel opening 140 may be formed in the single front cover 120.

If the door opening 130 and the panel opening 140 are formed in the single front cover 120, it is possible to combine the assembly processes of the front cover and the control panel into one assembly process. More specifically, the control panel device 170 may be mounted in the front cover 120 in advance and the front cover having the control panel device 170 mounted therein may be secured to the washer 100. As a result, when assembling the washer 100, the front cover 120 and the control panel device 170 do not need to be installed separately in separate assembly processes. Moreover, a worker may assemble the washer 100 efficiently, because the control panel device 170 may be mounted in the front cover 120 in advance and a single module formed.

Figure 3:
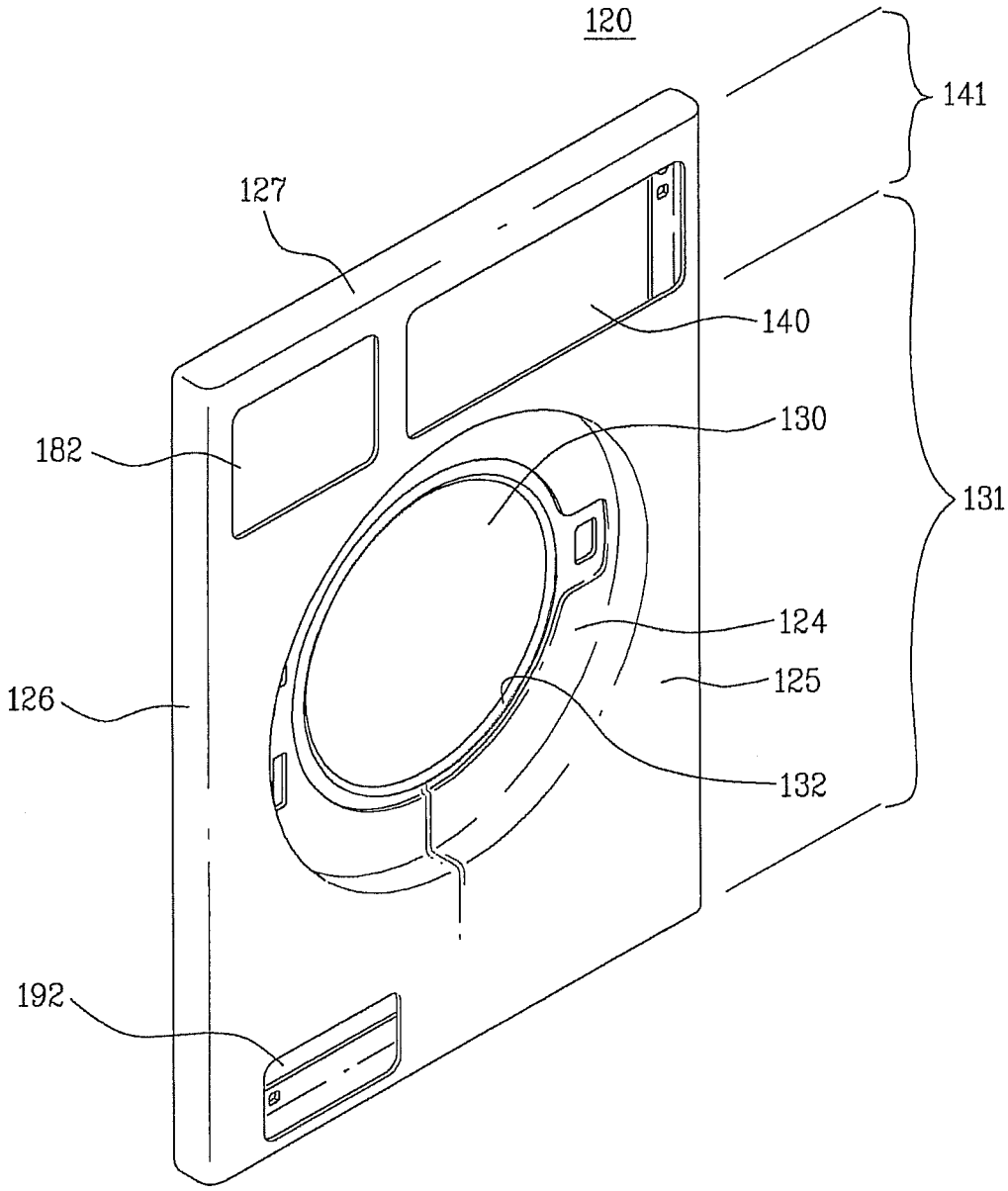
FIG. 3 is a front perspective view of the front cover of FIG. 2.
Figure 4:
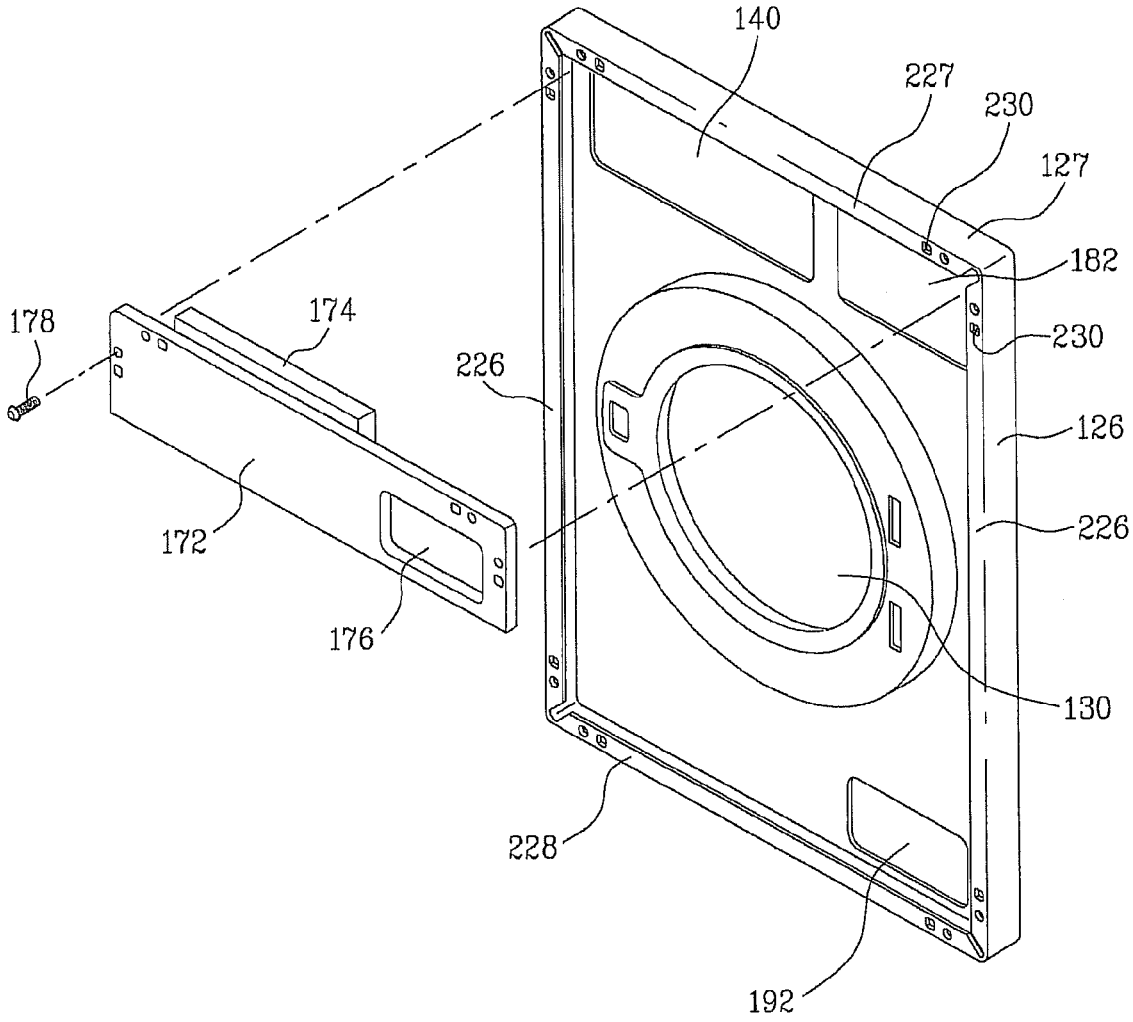
FIG. 4 is a rear perspective view of the front cover of FIG. 3.

FIG. 3 is a front perspective view of the front cover 120 of FIG. 2, after separating the front cover from the washer, while FIG. 4 is a rear perspective view of the front cover 120 of FIG. 3. Referring to FIG. 3, the front cover 120 according to this embodiment may include a front surface 125 and at least one side surface 126 formed continuously from the front surface 125.

As discussed above, the front surface 125 may include the door opening 130 and the panel opening 140. The door 122 (see FIG. 2) may be coupled to the door opening 130 and a control panel device 170 (see FIG. 2) may be coupled to the panel opening 140. As shown in FIG. 3, the panel opening 140 may be formed above the door opening 130; however, the panel opening 140 may also be formed below the door opening 130, or in another appropriate location.

The door opening 130 may be formed in a recessed part 124 formed in the front surface 125. That is, the door opening 130 may be formed in the front surface 125, or the recessed part 124 formed in the front surface 125, and the door opening 130 formed at a center of the recessed part 124. Thus, the recessed part 124 may form a predetermined space to hold the door 122 which is rotatably coupled to the door opening 130. As a result, when a user closes the door 122, the door 122 may be received in the recessed part 124 so as not to project substantially beyond the front surface 125.

A gasket 134 (see FIG. 2) may be connected to the door opening 130 to prevent water inside the drum 150 and the tub (not shown) from leaking into the cabinet 110. Further, a connection part 132 may extend along an inner circumference of the door opening 130 for the gasket 134 to be connected thereto.

As set forth above, at least one side surface 126 may be formed to extend from the front surface 125 continuously as one body with the front surface 125. A pair of side surfaces 126 may be formed at both opposite sides of the front surface 125, as shown in FIG. 3. Herein, the expression of "the side surface is formed continuously from the front surface" means that the side and front surfaces may be formed as a single member. The expression "formed continuously" herein does not mean that the front surface and the side surface are connected by welding. That is, the expression "formed continuously" means that the side surface and the front surface may be formed as the single member without a 'seam' formed by welding.

As shown in FIG. 3, when the panel opening 140 is formed above the door opening 130, the front surface 125 may be divided into a panel area 141 in which the panel opening 140 is formed and a door area 131 in which the door opening 130 is formed. That is, an upper area of the front surface 125 may be the panel area 141 and a lower area of the front surface 125 may be the door area 131, with respect to a center of a portion between the door opening 130 and the panel opening 140. In this case, the side surface 126 may be formed from each front portion of the panel area 141 and the door area 131. The side surfaces 126 of the panel area 141 and the door panel 131 may be formed continuously. In other words, the side surfaces 126 continuously formed from the panel area 141 and the door area 131 may be formed continuously from each other.

In addition, the front surface 125 of the front cover 120 may further include an upper surface 127 and a lower surface (not shown) continuously formed from the front surface 125, respectively. Either of the upper surface 127 and the lower surface may be formed from the front surface 125, or both the upper surface 127 and the lower surface may be continuously formed from the front surface 125.

As shown in FIG. 4, an upper flange part 227, a side flange part 226, and a lower flange part 228 may be formed extending from the upper surface 127, the side surface 126, and the lower surface, respectively. The flange parts 226, 227, and 228 may be used to secure the front cover 120 to the cabinet 110, and may be used to mount the control panel device 170 to the front cover 120.

The upper flange part 227 and the lower flange part 228 may extend from the upper surface 127 and the lower surface (not shown), respectively, not continuously formed with the side flange part 226. As shown in FIG. 4, while the upper surface 127, side surface 126, and lower surface (not shown) may be continuously formed from each other, the upper flange part 227 continuously formed from the upper surface 127, the side flange part 226 continuously formed from the side surface 126, and the lower flange part 228 continuously formed from the lower surface may not be continuously formed from each other but separately formed. The upper surface 127, the side surface 126, and the lower surface may be continuously formed from each other, because they are exposed outside as a part of the exterior of the washer. However, the flange parts do not have to be continuously formed from each other, because they are positioned in the cabinet 110 and are not exposed outside.

At least one coupling hole 230 may be formed in each of the flange parts 226, 227, and 228 for the front cover 120 to be connected with the cabinet 110 and for the control panel device 170 to be mounted to the front cover 120.

The above configuration may be applicable when either of the upper surface 127 and the lower surface is continuously formed from the front surface 125. More specifically, if only the upper surface 127 is continuously formed from the front surface 125, the upper surface 127 and the side surface 126 may be continuously formed from each other. However, in this case, the flange parts 227 and 226 extending from the upper surface 127 and the side surface 126, respectively, may not be continuously formed from each other but formed separately. That is applicable if only the lower surface is continuously formed from the front surface 125, and thus, the detailed description thereof will be omitted.

The control panel device 170 may be mounted in the front cover 120 according to embodiments disclosed herein to form a single module. That is, the front cover 120 having the control panel device 170 mounted therein may be assembled, which enables assembly workers to assemble a washer more easily with less assembly processes. More specifically, the control panel device 170 may include a mounting plate 172 which may be detachably coupled to the flange parts 227 and 226, and at least one selection part 174 mounted on the mounting plate 172 to be exposed outside through the panel opening 140.

As set forth above, the mounting plate 172 may be detachably connected to the upper flange part 227 and the side flange part 226. A plurality of coupling holes 230 may be formed in the upper flange part 227 and the side flange part 226, and the mounting plate 172 may be coupled to the flange parts 227 and 226 by at least one coupling member, such as a bolt 178. Although not shown in the drawings, if the panel opening 140 is formed below the door opening 130, the mounting plate 172 may be coupled to the side flange part 226 and the lower flange part 228.

As discussed above, at least one selection part 174 may be mounted on the mounting plate 172. The selection part 174 may be detachable. For example, the selection part 174 may be mounted to the mounting plate 172 by a securing part, such as a hook (not shown) or a bolt (not shown). Other means of mounting the selection part 174 to the mounting plate 170 may also be appropriate. The selection part 174 may be exposed outside through the panel opening 140 formed in the front surface 125 and a user may operate the selection part 174 to control an operation of the washer.

Although not shown in the drawings, a user may operate selection buttons provided on the selection part 174 to select, for example, a washing course or to adjust a water amount, washing time, a rinsing numbers, a rinsing time, a spin-drying time based on the selected washing course and a steam spray point, a steam amount when selecting steam spray. Other types of selection buttons may also be provided on the selection part 174.

In addition to the panel opening 140 and the door opening 130, a detergent box opening 182 may be formed in the front surface 125 of the front cover 120 and a detergent box 180 (see FIG. 2) may be mounted in the detergent box opening 182. The detergent box opening 182 may be formed at a predetermined portion of the front surface 125 that is adjacent to the panel opening 140. However, other positions for the detergent box opening 182 may also be appropriate. Further, the detergent box 180 may be retractably installed in an opening 176 of the mounting plate 172 through the detergent box opening 182. The structure by which detergent, fabric softener, and wash water are mixedly supplied to the detergent box 180 is similar to that of a conventional washer, and thus, detailed description thereof will be omitted.

Reference numeral 192 in FIGS. 3 and 4 is a service hole. The service hole 192 may be formed in a lower portion of the front surface 125 and may be covered by a service hole cover 190 (see FIG. 1). If maintenance and repair of the washer is needed, a service person may perform a maintenance/repair job in the washer through the service hole 192. That is, a service person may remove the service hole cover 190 from the service hole 192 to perform maintenance and repair of elements inside the washer.

The front cover 120 having the above described configuration may be fabricated with metal having an original metal gloss and color. For example, the front cover 120 may be fabricated with stainless steel. Since the washer 100 contacts with water quite often, the front cover 120 may be fabricated with stainless steel with an original metal color and gloss that will not easily corrode without a coating.

To improve the manufacture processing of the front cover manufactured using a drawing process, properties of various stainless steel series were researched and STS 300 series of stainless steel selected. FIG. 5 is a table illustrating properties of STS series of stainless steel, specifically, properties of STS 304, STS 304L, and STS 304J1.

Figure 6:
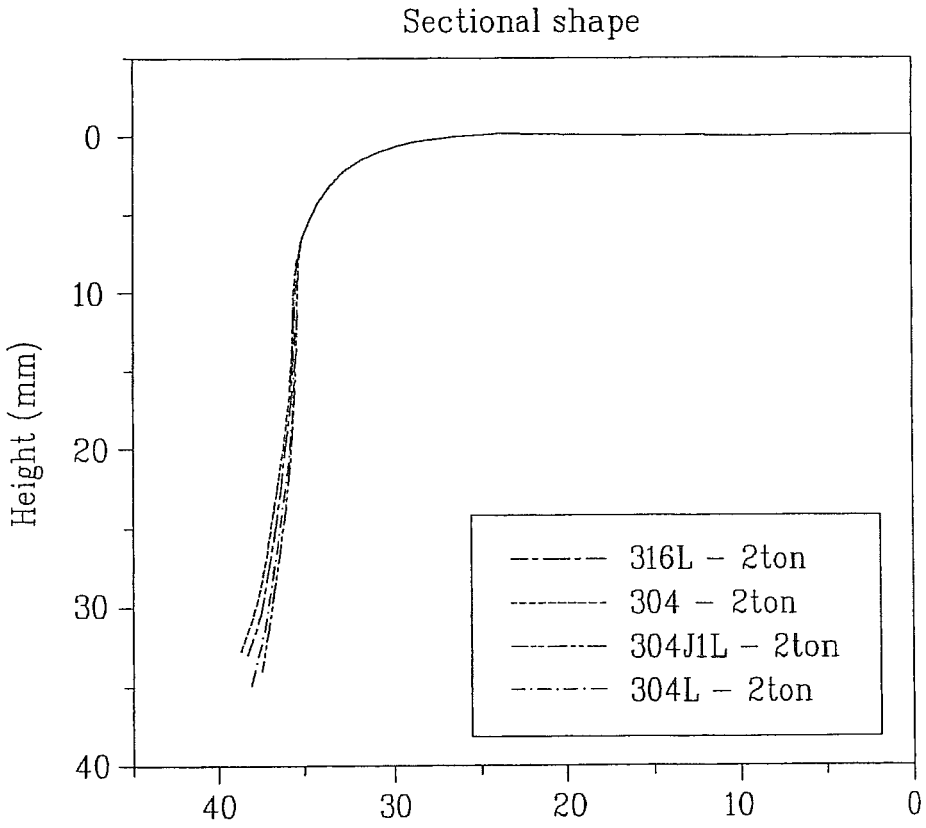
FIG. 6 is a graph illustrating degrees of spring back for various sample pieces manufactured using stainless steel.

As there may be a work hardening of stainless steel, the STS 200 series of stainless steel was drawn and sample pieces made to examine degrees of spring back of the sample pieces. Hence, a graph shown in FIG. 6 was made and the results analyzed. The spring back of STS 304J1 stainless steel was found to be the smallest in the STS series of stainless steel.

A laundry treating apparatus according to embodiments disclosed herein has at least the following advantages.

Embodiments reduce the time and cost needed to assemble a laundry treating apparatus, because assembly processes are reduced. Further, a front cover of a laundry treating apparatus according to embodiments may be made of a unique metal color and gloss. Furthermore, embodiments disclosed herein provide a laundry treating apparatus capable of being manufactured easily by reducing the necessary manufacturing processes.

One embodiment broadly described herein provides a laundry treating apparatus that includes a cabinet, a drum rotatably provided in the cabinet to hold laundry therein, a front cover including a door opening to load the laundry in the drum, and at least one panel opening to mount a control panel unit. The front cover may include a front surface and at least one side surface continuously formed from the front surface.

Further, the front cover may be divided into a panel area in which the panel opening is formed and a door area in which the door opening is formed. A side surface of the panel area and a side surface of the door area may be continuously formed from each other.

The front cover may include a pair of side surfaces continuously formed from the front surface. The front cover may further include an upper surface continuously formed from the front surface. The upper surface and the at least one side surface may be continuously formed from each other. In addition, the at least one side surface and the upper surface may include at least one side flange part and an upper flange part, respectively. Each of the flange parts may be separately formed.

The control panel unit or device may be detachably secured to the at least one side flange part and the upper flange part. The control panel unit may include a mounting plate detachably secured to the at least one side flange part and the upper flange part, and at least one selection part mounted on the mounting plate so that a user may operate the selection part outside the front cover through the at least one panel opening to control an operation of the washer.

The front cover may further include a detergent box opening in which a detergent box may be mounted. The detergent box may be mounted to the mounting plate, so as to be retractable through the detergent box opening.

The front cover may further include a lower surface continuously formed from the front surface. The lower surface and the at least one side surface may be continuously formed from each other. The at least one side surface and the lower surface may include at least one side flange part and a lower flange part, respectively. Each of the flange parts may be separately formed.

The front cover may further include an upper surface and a lower surface that may be formed continuously formed from the front surface. The upper surface and the lower surface may be continuously formed from the at least one side surface, respectively. The upper surface, the at least one side surface, and the lower surface may include an upper flange part, at least one side flange part, and a lower flange part. Each of the flange parts may be separately formed.

The control panel unit may be detachably secured to the upper flange part and the at least one side flange part. The control panel unit may include a mounting plate detachably secured to the at least one side flange part and the upper flange part, and at least one selection part mounted on the mounting plate so that a user operates the selection part outside the front cover through the at least one panel opening to control an operation of the washer.

The front cover may further include a detergent box opening in which a detergent box may be mounted. The detergent box may be mounted to the mounting plate, so as to be retractable through the detergent box opening.

A recessed part may be formed in the front surface of the front cover and the door opening may be formed in the recess part. The front cover may further include a connection part that extends along an inner circumference of the door opening to be connected with a gasket. The front cover may be configured of stainless steel.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method of manufacturing a laundry treating apparatus, the method comprising:

providing a cabinet having an open front portion, and a modular control panel having a mounting plate coupled to a selection controller;

forming a front panel for the cabinet to comprise a continuous front surface having at least three openings, including a door opening for a door, a panel opening for the modular control panel, and a detergent box opening for a detergent box, a plurality of side surfaces which extend continuously from the front surface, at least one seamless corner where the front surface and two of the plurality of side surfaces meet, and a plurality of flanges extending from the plurality of side surfaces, a plurality of coupling holes being formed in the plurality of flanges;

mounting the modular control panel to a rear of the front panel by securing the mounting plate to the plurality of flanges by a plurality of coupling members and the plurality of coupling holes; and mounting the front panel in combination with the modular control panel as a single module to the open front portion of the cabinet after mounting the modular panel to the rear of the front panel, wherein the mounting of the modular control panel to the front panel by securing the modular control panel to the plurality of flanges comprises inserting the selection controller of the modular control into the panel opening, and attaching the mounting plate of the modular control panel to the plurality of flanges, wherein the selection controller is exposed outside through the panel opening.

2. The method of claim 1, further comprising:

installing the detergent box at the mounting plate through the detergent box opening, wherein the continuous front surface of the front panel corresponds to an outermost panel of the laundry treating apparatus, the outermost panel being located along an exterior surface of the laundry treating apparatus with no overlapping aesthetic cover.

3. The method of claim 1, wherein the front panel is made of a material which includes STS 304J1-type stainless steel.

4. The method of claim 1, wherein the panel opening is disposed above the opening for the door.

5. The method of claim 1, wherein the door opening is recessed relative to surrounding portions of the front panel.

6. The method of claim 1, further comprising:

providing at least one service opening.

7. The method of claim 1, wherein the panel opening is configured to receive the modular control panel from a rear surface thereof with the modular control panel secured to at least one of the plurality of flanges.

8. The method of claim 1, wherein at least one of the plurality of flanges is configured to allow the modular control panel to be secured thereto by at least one fastener.

9. The method of claim 1, wherein the plurality of flanges do not connect to one another.

10. The method of claim 1, wherein the plurality of side surfaces comprise top, bottom, left, and right side surfaces.

11. The method of claim 1, wherein the at least one seamless corner is not formed by a joining process.

12. The method of claim 11, wherein the at least one seamless corner is not formed by welding.

13. The method of claim 1, wherein the at least one seamless corner comprises at least two seamless corners.

14. The method of claim 1, wherein the at least one seamless corner comprises a seamless corner formed at a corner where the front surface and two of the plurality of side surfaces meet.

15. A method of manufacturing laundry treating apparatus, the laundry treating apparatus comprising:

providing a cabinet having an open front portion and a modular control panel having a mounting plate coupled to a selection controller;

forming a front panel comprising a continuous front surface including a door opening for a door, a panel opening for the control panel, and a detergent box opening for a detergent box, wherein the modular front panel is made of stainless steel, a plurality of side surfaces that extend continuously from the front surface at an angle relative to the front surface, at least one corner of the front panel comprising three continuously formed surfaces that are oriented substantially perpendicular to one another, and a plurality of flanges extending from the plurality of side surfaces, a plurality of coupling holes being formed in the plurality of flanges;

mounting the modular control panel to a rear of the front panel by securing the mounting plate to the plurality of flanges by a plurality of coupling members and the plurality of coupling holes; and mounting the front panel in combination with the modular control panel to the open front portion of the cabinet after mounting the modular control panel to the rear of the front panel.

16. The method of claim 15, wherein one of the plurality of side surfaces is a top side surface, and wherein a top surface of the cabinet is substantially coplanar with the top side surface.

17. The method of claim 16, further comprising:

securing the front panel to the plurality of flanges extending from the side surfaces by one or more fasteners, the one or more fasteners oriented in a direction substantially parallel to the top side surface, such that the one or more fasteners are hidden from view along the exterior surface of the laundry treating apparatus by the front surface of the front panel.

18. The method of claim 16, wherein the top surface of the cabinet is a continuous planar surface extending from the top side surface of the front panel to a back edge of the cabinet.

19. The method of claim 15, wherein the plurality of side surfaces includes a first side surface opposite a second side surface and a third side surface opposite a fourth side surface, wherein the first and second side surfaces are parallel with one another and angled relative to the third and fourth side surfaces, the third and fourth side surfaces being parallel, wherein the plurality of flanges includes a first flange extends from the first side surface, a second flange extends from the second side surface, a third flange extending from the third side surface, and a fourth flange extending from the fourth side surface, and wherein each of the first, second, and third flanges receives at least a respective number of fasteners to allow the modular control panel to be fastened to be coupled to the front panel.

20. The method of claim 19, wherein, the first and third flanges are spaced from one another at a location aligned with a seamless corner which continuously extends between the first and third side surfaces, and the second and third flanges are spaced from one another at a location aligned with a seamless corner which continuously extends between the second and third side surfaces.

21. The method of claim 19, wherein at least one of the first, second, or third flanges receives multiple fasteners to allow the modular control panel to be coupled to the front panel.

22. The method of claim 15, wherein the modular mounting plate of the control panel formed as a single module includes the opening for the detergent box, and wherein the detergent box is retractably installed in the opening of the mounting plate through the detergent box opening.

* * * * *